United States Patent [19]

Greenlee

[11] 4,043,453

[45] Aug. 23, 1977

[54] HOLDER AND DISPLAY DEVICE FOR WRENCH SOCKETS

[75] Inventor: Hugh T. Greenlee, Gates Mills, Ohio

[73] Assignee: The Wright Tool & Forge Company, Barberton, Ohio

[21] Appl. No.: 685,395

[22] Filed: May 11, 1976

[51] Int. Cl.[2] ..... B65D 85/20; B65D 73/00

[52] U.S. Cl. ..... 206/349; 206/378; 206/477; 206/493; 211/60 T; 206/806

[58] Field of Search ..... 206/378, 373, 375, 372, 206/349, 477, 480, 483, 493, 806, 303; 248/309, 310, 311; 211/13, 60 T; 220/306, 307

[56] References Cited

U.S. PATENT DOCUMENTS

| | | | |
|---|---|---|---|
| 1,596,951 | 8/1926 | Smith | 206/375 |
| 1,712,473 | 5/1929 | McWethy | 206/378 |
| 3,027,012 | 3/1962 | Talmadge | 211/113 |
| 3,221,891 | 12/1965 | Snow | 211/13 |
| 3,674,138 | 7/1972 | Gilmour | 206/349 |
| 3,726,393 | 4/1973 | Thompson | 206/378 |

*Primary Examiner*—William T. Dixson, Jr.
*Attorney, Agent, or Firm*—Bosworth, Sessions & McCoy

[57] ABSTRACT

A holder and display unit for a socket of the type used in a socket wrench tool, including a fastening device for anchoring the socket to the display unit. The socket has a square recess for the male stud on the wrench drive component and the recess has a transverse detent hole in its sidewall of the type that cooperates with a detent ball or the like on the drive stud to retain the socket on the drive component. The fastening device has a head and a male plug portion that extends through an aperture in the display unit and into the square recess in the socket. A resilient arm on the male plug portion has a catch that registers with and snaps into the transverse detent hole. This releasably latches the fastening device, display unit and socket together.

1 Claim, 8 Drawing Figures

FIG. 6
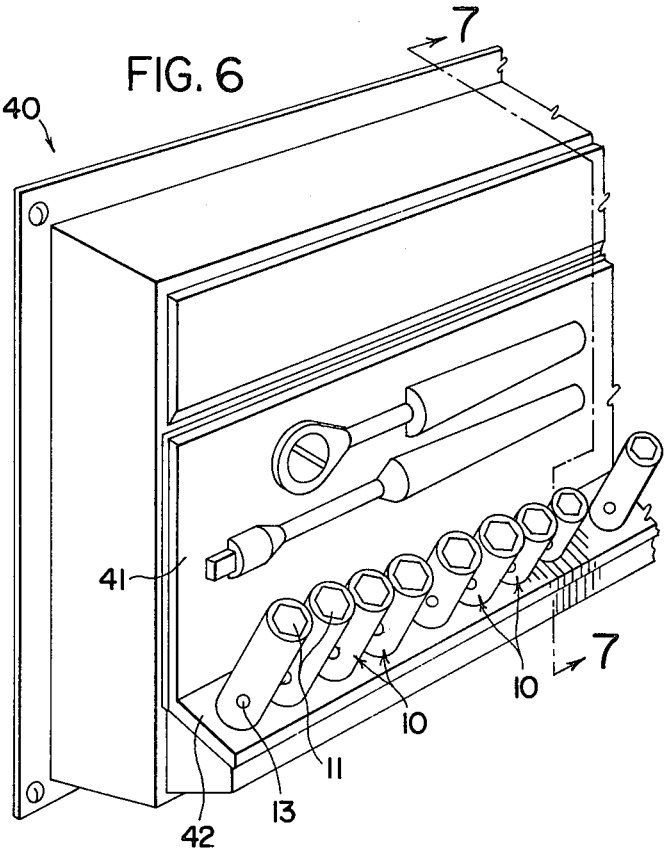
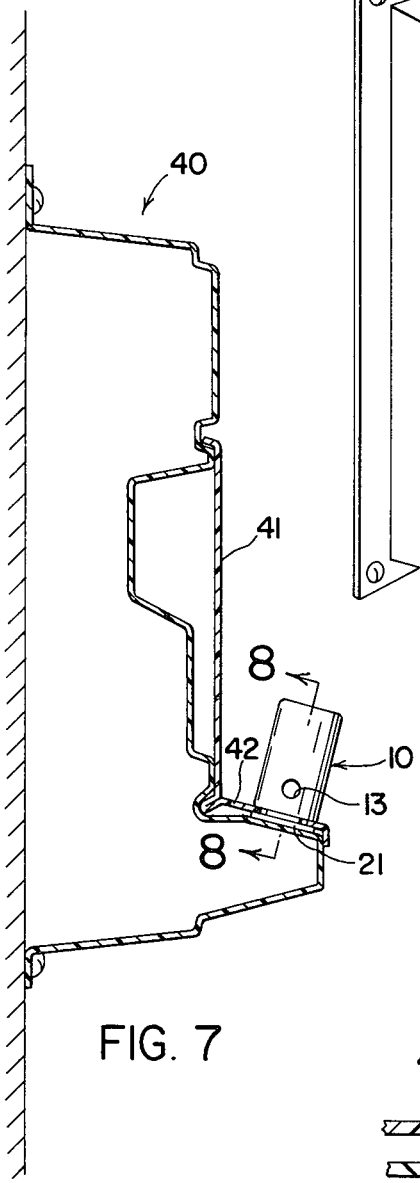
FIG. 7
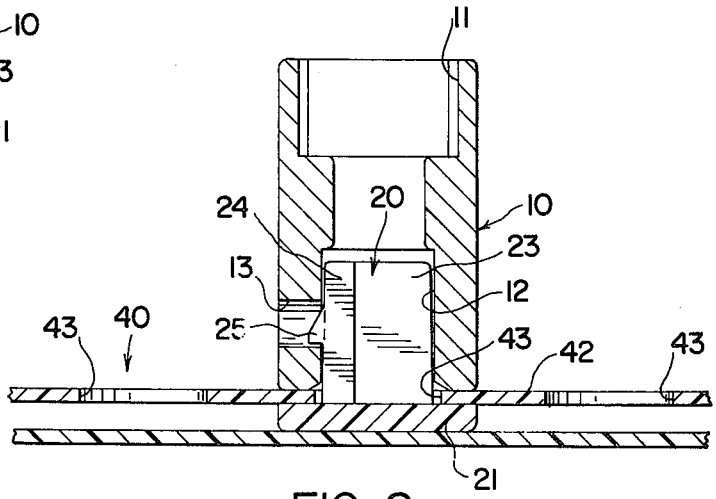
FIG. 8

HOLDER AND DISPLAY DEVICE FOR WRENCH SOCKETS

BACKGROUND OF THE INVENTION

This invention relates to the display of socket wrench tool sets and the like and especially to the display of the individual sockets that are used with various types of wrench-type drives to engage and turn a threaded fastener such as a machine screw, a bolt, etc. More particularly, the invention relates to the combination of the fastening device for anchoring the socket to the display unit and the unique display unit itself.

Socket wrench tool sets are usually displayed at the point of sale in the boxes and other packaging in which the tool sets are transported and stored. This method of display has certain disadvantages that detract from the marketing appeal of the product. One disadvantage is that the various components of the tool set are not all easily seen by a prospective purchaser and cannot be easily handled and manipulated. Another disadvantage is that packaging the complete wrench tool sets does not readily accommodate the separate display and sale of individual sockets.

With the introduction of the UPC coding system another problem arises. Since some form of tag or label containing printed matter must be attached to individual sockets, it is necessary that each separate socket be provided with a tag or label containing sufficient display area--usually as large as the socket itself, to permit the UPC code to be applied and readily displayed.

In the past, the only type of packaging used for individual sockets has been a large display card to which one or more sockets are stapled or fastened with plastic sheet or film that may be applied by vacuum, for example, or performed to fit over the socket and then adhered to the face of the card. All of these technizues tend to detract from the appearance of the socket and prevent the customer from closely inspecting it and manipulating it.

The device of the present invention, however, resolves the difficulties indicated above and affords other features and advantages heretofore not obtainable.

SUMMARY OF THE INVENTION

It is among the objects of the invention to hold and display individual sockets for socket wrench tools in a manner that permits the socket to be handled and examined by a customer at the point of sale and that permits a substantial amount of information to be displayed with the individual socket.

Another object is to secure a display means and hanger or holder to an individual socket for a socket wrench tool at the point of sale.

These and other objects and advantages are accomplished with the unique combination of the invention, which, includes together with an individual wrench tool socket of conventional construction, a display means having a flat sheet portion with an aperture therein and a fastening device for anchoring the display means to the socket. In the conventional manner the socket has a rectangular recess in one end for receiving a wrench tool drive stud or the like and a transverse detent hole in the sidewall of the recess intended to cooperate with a detent ball or the like on the drive stud.

The fastening device has a head larger than the aperture in the display means and a male plug portion adapted to extend through the aperture and be snugly received in the square recess in the socket. The male plug portion includes a resilient arm with a catch formed thereon and adapted to latch in the transverse opening. The resilient arm is movable between a flexed position (when being inserted) and an unflexed latching position (when fully inserted). When the plug portion of the fastener is moved through the aperture in the display means and inserted into the square recess with the catch in alignment with the detent hole, the arm is flexed inwardly due to the interfering engagement between the catch and the side of the recess until the catch enters the detent hole whereupon the resilient arm returns to its unflexed position to anchor the socket to the display means.

The display means may be, for example, a strip of cardboard folded to form an enclosed loop such as a triangular loop, or may be a box-like display unit with a shelf provided with one or more apertures through which the fastening device is inserted to anchor the socket or sockets to the display box.

BRIEF DESCRIPTION OF THE DRAWINGS

FIG. 6 is a perspective view of a socket wrench tool set display unit with components displayed therein including a number of wrench tool sockets anchored in accordance with the invention;

FIG. 7 is a sectional view taken on the line 7—7 of FIG. 6; and

FIG. 8 is a fragmentary sectional view on an enlarged scale taken on the line 8—8 of FIG. 7.

DESCRIPTION OF THE PREFERRED EMBODIMENTS

Figure 1:
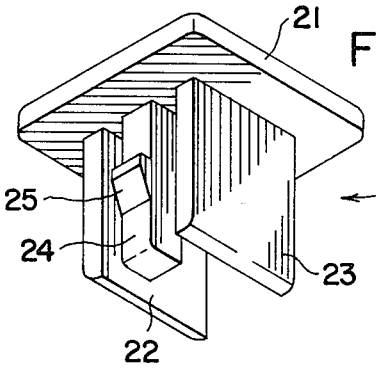
FIG. 1 is a perspective view from below of a fastening device used in the combination of the invention.
Figure 2:
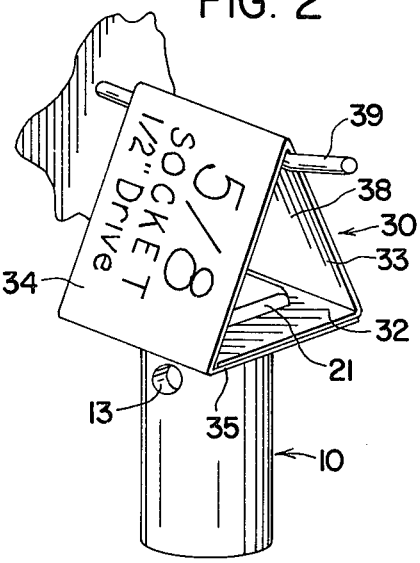
FIG. 2 is a perspective view of a socket anchored to a display card with the fastening device of FIG. 1.

Referring more particularly to the drawings and initially to FIGS. 1 through 5 there are shown a conventional socket 10 for a socket wrench tool set and a fastening device 20 for anchoring the socket 10 to a display card 30 or some other display means. The socket 10 is of conventional design (FIGS. 3 and 4) and includes a socket recess 11 adapted to fit over and engage the hexagonal head of a threaded fastener such as a machine screw or bolt.

At the other end of the socket 10 is a square recess 12 adapted to receive the male drive stud (not shown) of a socket wrench drive component which may be one of several different types of components as will be readily apparent to those familiar with the art. The recess 12 is also provided with a transverse detent hole 13 adapted to cooperate with a detent ball or the like on the male drive stud.

Figure 3:
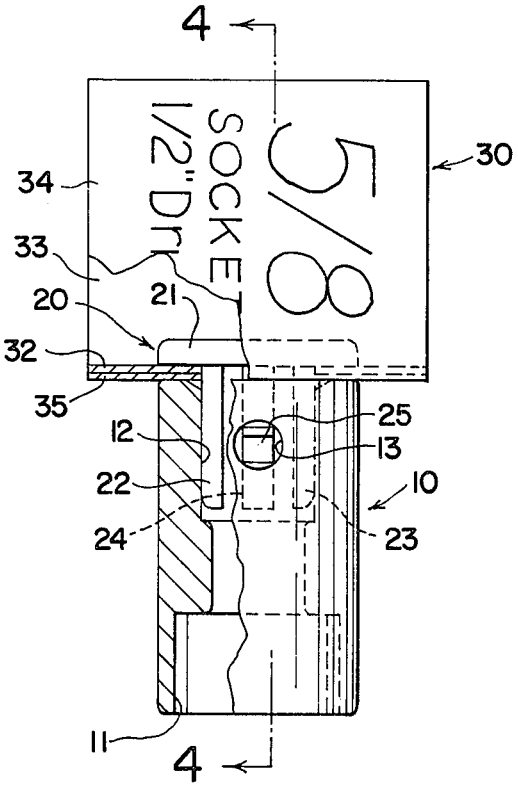
FIG. 3 is an elevational view of the combined socket and display card of FIG. 2 with parts broken away for the purpose of illustration.
Figure 4:
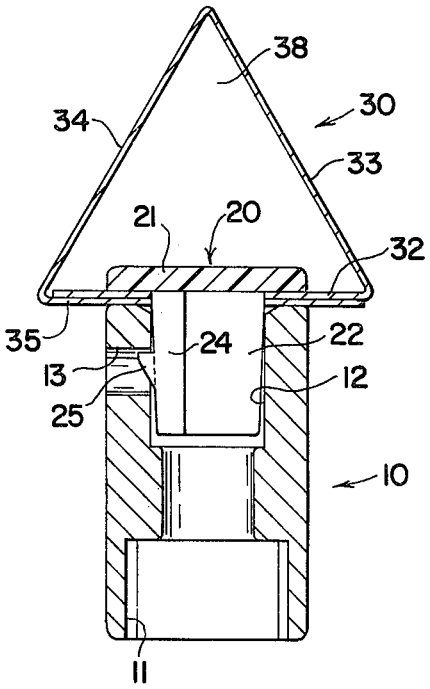
FIG. 4 is a sectional view taken on the line 4—4 of FIG. 3.

The socket 10 is anchored to the display card 30 with the fastening device 20, the construction of which is best illustrated in FIG. 1 and the function and operation of which are best illustrated in FIGS. 3 and 4. The fastening device 20 has a square head 21 and a male plug portion including a pair of spaced parallel rectangular legs 22 and 23. The legs 22 and 23 are spaced from one another in such a way as to define a square cross section adapted to match the square recess 12 in the socket 10. Accordingly, the legs are adapted to be inserted into the recess and be received and snugly therein.

Located between the two legs 22 and 23 is a resilient arm 24 with an outwardly extending catch 25 formed thereon. The catch 24 as illustrated in FIGS. 3 and 4 is adapted to register and cooperate with the transverse detent hole 13 in the recess 12 such a way as to latch the fastening device 22 to the socket. The catch 25 may be forced out of the transverse detent hole 13 if desired by inserting an implement through the socket recess 11 in the socket 10 and upwardly into the lower end of the square recess 12. The implement may then be inserted between the wall of the square recess 12 and the resilient arm 24. By prying the resilient arm 24 inwardly with the implement the catch 25 may be moved out of the detent hole 13 to permit the fastening device 20 to be separated from the socket 10.

Figure 5:
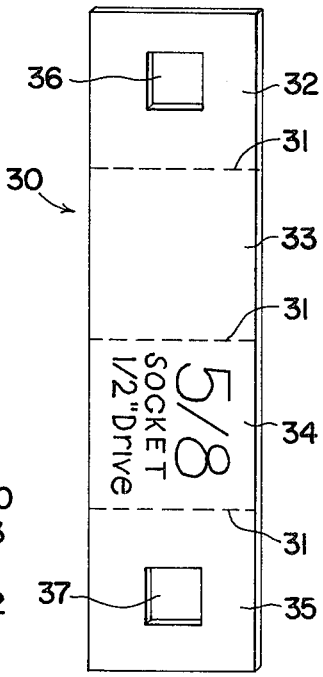
FIG. 5 is a perspective view of a cardboard strip prior to being folded into the condition illustrated in FIGS. 2, 3 and 4 to form a display card to be used in the combination of the invention.

FIG. 5 shows the display card 30 prior to being formed into a holder for the socket 10. The card 30 is formed of an elongated flat sheet of cardboard with transverse fold lines 31 at three locations uniformly spaced from one another. The fold lines 31 divide the flat sheet into three square sections 32, 33, 34 and 35. The end sections 32 and 35 are each provided with a central square opening 37 of a size to match the square recess 12 in the socket 10 and the plug portion defined by the two legs 22 and 23. The sheet illustrated in FIG. 5 is folded along the fold lines 31 to form a triangular loop 39 best shown in FIGS. 2, 3 and 4, with the sections 32 and 35 overlapping and the two square openings 36 and 37 in registration with one another.

With the display card thus formed the fastening device 20 may be passed through the square openings 36 and 37 and then into the square recess 12 of the socket to anchor the display card to the socket as illustrated in FIGS. 3 and 4. The loop 38 formed by the display card 30 is useful in hanging the socket 10 on a horizontal rod such as the type of rod 39 that might be mounted on perforated board of "MASONITE" of the type commonly used in retail stores for display purposes. It will be noted that the entire width of the display card 30 functions in a load carrying capacity when the assembly is hung on the rod 39.

FIG. 6, 7 and 8 illustrate a modified combination embodying the invention wherein one or more sockets 10 may be secured and displayed on a display box 40 that is adapted to display, for example, a complete socket wrench tool set. The box 40 has an insert 41 carried thereon with a flat sloping shelf 42 at the lower end. The shelf 42 has a plurality of square openings 43 which receive the plug portion of the fasteners 20 for the purpose of anchoring one or more sockets 20 in a generally upright position on the shelf 42. Thus, the sockets 10 are anchored merely by passing the plug portions of one or more fastening devices 20 through the square openings 43 from below and then pressing the sockets over the plug portions until the respective catch 25 snaps into the transverse opening 13. With this arrangement the sockets 10 may be displayed and the UPC code clearly shown on an attached display means at the point of sale.

With the arrangement of FIGS. 1 through 5 a prospective customer may easily handle, examine and manipulate the socket tool, however, pilferage is inhibited in that it would be fairly difficult for a prospective thief to remove the fastening device and display card from the socket in full view of attendants and other customers.

However, the fastening device 20 may be easily removed from a purchased socket once the purchaser is ready to use it by inserting an implement through the socket recess 11 and prying the resilient arm 24 inwardly to remove the catch 25 from the recess 13 and permit separation of the fastening device 20.

While the invention has been shown and described with respect to specific embodiments thereof this is intended for the purpose of illustration rather than limitation and other variations and modifications of the specific combinations herein shown and described will be apparent to those skilled in the art all within the intended spirit and scope of the invention. Accordingly, the patent is not to be limited in scope and effect to the specific combinations herein shown and described nor in any other way that is inconsistent with the extent to which the progress in the art has been advanced by the invention.

I claim:

1. In combination, an elongated flat cardboard strip folded along transverse fold lines to form three connected sides defining a triangular hanger loop with an aperture in one of said sides, a socket for a socket wrench tool and a fastening device for anchoring said socket to said triangular loop, said socket having a rectangular recess at one end for receiving a socket wrench tool drive stud and a transverse detent hole in the sidewall of said recess, and said fastening device having a head larger than said aperture and a male plug portion adapted to extend through said aperture inn said side of said loop and be snugly received in said recess, said male plug portion comprising a pair of spaced parallel legs that define in transverse section, a rectangle corresponding to said rectangular recess in said socket, and including a resilient arm located between said legs and adjacent a wall of said recess between said legs with a transversely extending catch adapted to latch in said opening, said resilient arm being movable between a flexed position and an unflexed latching position, whereby when said male plug portion is moved through said aperture in said side of said loop from the inside out and inserted in said recess with said catch in alignment with said detent hole, said resilient arm is flexed until said catch enters said detent hole whereupon said resilient arm returns to its unflexed position to anchor said socket to said loop whereby said loop may be used to hang said socket for display.

* * * * *